US011295915B2

(12) United States Patent
Hierl

(10) Patent No.: US 11,295,915 B2
(45) Date of Patent: Apr. 5, 2022

(54) THERMALLY TRIGGERABLE INDICATING OR SWITCHING DEVICE

(71) Applicant: DEHN SE + CO KG, Neumarkt (DE)

(72) Inventor: Stephan Hierl, Neumarkt (DE)

(73) Assignee: DEHN SE + CO KG, Neumarkt (DE)

( * ) Notice: Subject to any disclaimer, the term of this patent is extended or adjusted under 35 U.S.C. 154(b) by 0 days.

(21) Appl. No.: 17/413,041

(22) PCT Filed: Nov. 13, 2019

(86) PCT No.: PCT/EP2019/081159
§ 371 (c)(1),
(2) Date: Jun. 11, 2021

(87) PCT Pub. No.: WO2020/120057
PCT Pub. Date: Jun. 18, 2020

(65) Prior Publication Data

US 2022/0013314 A1 Jan. 13, 2022

(30) Foreign Application Priority Data

Dec. 12, 2018 (DE) ..... 102018131975.4

(51) Int. Cl.
*H01H 37/76* (2006.01)

(52) U.S. Cl.
CPC ..... *H01H 37/761* (2013.01); *H01H 37/764* (2013.01); *H01H 2037/762* (2013.01)

(58) Field of Classification Search
CPC ..... H01H 37/76; H01H 37/761; H01H 37/74; H01H 37/764–767; H01H 2037/762–763; H01H 2037/768–769
See application file for complete search history.

(56) References Cited

U.S. PATENT DOCUMENTS 3,761,856 A 9/1973 Mantelet ..... 337/409
3,924,218 A * 12/1975 Plasko ..... H01H 1/16 337/407

(Continued)

FOREIGN PATENT DOCUMENTS

DE 2220264 A1 11/1972 ..... A47J 27/00
DE 102006037551 B4 3/2012 ..... H02H 5/04

(Continued)

OTHER PUBLICATIONS

The Notification Concerning Transmittal of International Preliminary Report on Patentability (Chapter I of the Patent Cooperation Treaty), in English, dated Jun. 24, 2021, which was issued by the International Bureau of WIPO in Applicant's corresponding international PCT application having Serial No. PCT/EP2019/081159, filed on Nov. 13, 2019.

(Continued)

*Primary Examiner* — Jacob R Crum
(74) *Attorney, Agent, or Firm* — Bodner & O'Rourke, LLP; Gerald T. Bodner; Christian P. Bodner

(57) ABSTRACT

The invention relates to a thermally triggerable indication or switching device, having a movable, mechanically preloaded slide which directly or indirectly triggers or actuates the indication or switching device, and having a preformed part which changes its state of aggregation under the effect of heat, the preformed part, in the functional state, being adapted to be arranged so as to block the movable slide. According to the invention, in the initial state, the preformed part is loosely located in a receiving space. For transferring the preformed part to the functional state, the slide is moved in a position such that a gap space opens between the slide and a slide stop, wherein the preformed part enters the gap space and the slide is simultaneously preloaded.

8 Claims, 4 Drawing Sheets

(56) References Cited

U.S. PATENT DOCUMENTS

| | | | | |
|---|---|---|---|---|
| 4,060,787 | A * | 11/1977 | Budnik | H01H 37/765 337/408 |
| 10,229,774 | B2 | 3/2019 | Durth | |
| 2012/0194315 | A1* | 8/2012 | Matthiesen | H01H 37/761 337/142 |
| 2012/0194317 | A1* | 8/2012 | Vranicar | H01H 37/761 337/401 |
| 2013/0200984 | A1* | 8/2013 | Matthiesen | H01H 37/761 337/186 |
| 2013/0337691 | A1 | 12/2013 | Striewe et al. | 439/625 |
| 2016/0042905 | A1* | 2/2016 | Xu | H01H 37/764 337/148 |
| 2016/0240290 | A1* | 8/2016 | Hirschmann | H01H 71/10 |
| 2020/0013572 | A1 | 1/2020 | Hierl | |

FOREIGN PATENT DOCUMENTS

| | | | | |
|---|---|---|---|---|
| DE | 102010061110 | A1 | 6/2012 | H01H 37/76 |
| DE | 102015213050 | A1 | 1/2017 | H01C 7/12 |
| DE | 102015014163 | A1 | 3/2017 | H01H 37/18 |
| DE | 102017105436 | B3 | 6/2018 | H01H 37/04 |
| DE | 102018125520 | A1 | 4/2020 | H01H 37/72 |
| EP | 3252794 | A1 | 12/2017 | H01C 7/12 |
| EP | 3252794 | B1 | 8/2018 | H01C 7/12 |
| LU | 93090 | B1 | 12/2017 | H01C 7/12 |
| WO | WO2007093572 | A1 | 8/2007 | H01C 7/12 |
| WO | WO2017009355 | A1 | 1/2017 | H01C 7/12 |

OTHER PUBLICATIONS

The English translation of the International Preliminary Report on Patentability (Chapter I of the Patent Cooperation Treaty), dated Jun. 8, 2021, which was issued by the International Bureau of WIPO in Applicant's corresponding international PCT application having Serial No. PCT/EP2019/081159, filed on Nov. 13, 2019.

The Written Opinion of the International Searching Authority, in English, dated Feb. 5, 2020, which was issued by the International Bureau of WIPO in Applicant's corresponding international PCT application having Serial No. PCT/EP2019/081159, filed on Nov. 13, 2019.

The International Search Report, in English, dated Feb. 5, 2020, which was issued by the International Bureau of WIPO in Applicant's corresponding international PCT application having Serial No. PCT/EP2019/081159, filed on Nov. 13, 2019.

* cited by examiner

THERMALLY TRIGGERABLE INDICATING OR SWITCHING DEVICE

The invention is based on a thermally triggerable indication or switching device having a movable slide which is adapted to be preloaded mechanically and which directly or indirectly triggers or actuates the indication or switching device, and having a preformed part which changes its state of aggregation under the effect of heat, the preformed part, in the functional state, being adapted to be arranged so as to block the movable slide, according to the preamble of claim 1.

Document DE 10 2017 105 436 B3 discloses a thermally triggerable, mechanical switching device. The latter is composed of a heat-sensitive means and of a mechanical energy storing device, the heat-sensitive means being formed as a melting preformed part. The melting preformed part blocks the motion path of a switching piece formed as a tappet or opens this motion path. The tappet is preloaded by the mechanical energy storing device. A housing which accommodates the aforementioned means is furthermore present. The tappet is mounted in the interior of the housing and can be shifted through an end-face opening. Under preload, the tappet is supported against the melting preformed part, the melting preformed part being arranged so as to cover a second opening arranged opposite the end-face opening. When the melting temperature of the melting preformed part is reached, the latter is displaced by the tappet and the tappet is moved in a modified positional location. An indication or switching device is thus adapted to be triggered directly or indirectly.

In the surge arrester having at least one discharge element, for example a varistor, and a disconnecting device according to DE 10 2006 037 551 B4, the at least one discharge element is to be disconnected from the mains on one or on all poles.

The disconnecting device comprises a soldering point which is integrated into the electrical connection path within the arrester. The soldering point is connected via a movable conductor section or a movably conducting bridge to the discharge element, on the one hand, and the conductor section or the bridge, on the other hand, to an electrical external connection of the arrester. A spring generating a preload force is furthermore present, the corresponding force vector acting indirectly or directly onto the conductor section or the bridge in the direction of disconnection.

A thermally triggerable locking element blocks the movable conductor section or the movable conducting bridge with respect to the preload force vector such that the soldering point of the disconnecting device is not subjected to any permanent force-side stress.

The solution according to DE 10 2006 037 551 B4 may prevent the thermally activatable element which is for example formed as a solder bead, from being subjected to a mechanical stress over the entire service life, starting with the manufacture of a corresponding product. The presented solution is however very complex in terms of design and therefore cost-intensive.

On the basis of the aforementioned, it is the object of the invention to specify a thermally triggerable indication or switching device which has a movable, mechanically preloaded slide and a preformed part which changes its state of aggregation under the effect of heat and which can be manufactured in a simple way and at low cost, and in which there is the possibility for the device to be activated subsequently, i.e. irrespective of the actual mounting and manufacturing process. Consequently, there should be the possibility to bring the thermal triggering function into readiness only if a use of the component part or component element equipped therewith is intended or has taken place.

Therefore, the object of the invention is to permit a quasi-release of the indication or switching device by the customer, wherein the used preformed part is thus simultaneously prevented from being subjected to a previously generated, unnecessary stress.

The object of the invention is achieved by the combination of features according to claim 1 and a surge arrester arrangement according to claim 8.

Accordingly, it is proceeded from a thermally triggerable indication or switching device which has a movable, mechanically preloaded slide.

The slide can directly or indirectly trigger or actuate the indication or switching device.

The slide itself can be located as an insulating separating slide between two contacts and either interrupt or close these contacts. However, the slide can also actuate a micro key or the like which is known per se.

The indication device may be designed in the form of an indication area which is located below an indication window and uses an optical color change. Professional variations of the indication and/or switching device are here of course conceivable without departing from the basic idea of the invention.

A preformed part which changes its state of aggregation under the effect of heat is furthermore present. The preformed part may be, for example, a pellet or a similar element made of a solder, a wax or a thermoplastic material.

In the functional state, the preformed part is arranged so as to block the movable slide.

According to the invention, in the initial state, i.e. on the manufacturing side, the preformed part is loosely located in a receiving space.

For transferring the preformed part to the functional state, the slide is moved in a position such that a gap space opens between the slide and a slide stop.

Here, this may involve a gap space between the slide and a support, for example a base plate of the corresponding device.

Supported by an elastic or flexible arm connected to the slide, the preformed part now enters the gap space. By moving the slide in the position for forming the gap space, the slide is simultaneously preloaded. This can be realized by a spring arrangement.

After having transferred the preformed part into the gap space and the slide is subjected to the preload, the end of the slide pointing towards the gap space comes into contact with and fixes the preformed part. The elastic or flexible arm now protects the preformed part in the gap space from being pushed out or from falling out.

If the temperature now increases in the region of the gap space, i.e. in the space in which the preformed part is located, the latter can change its state of aggregation when its melting temperature is reached. The preload force of the slide thus acts on the preformed part. The stop which is no longer rigid lengthens the motion path of the slide such that the gap space is gradually further reduced, more specifically by displacing the material of the preformed part into an existing clearance.

As a result, the corresponding indication or switching device is now triggered.

For supporting the movement of the solder preformed part to activate the indication or switching device, the arm includes a sliding inclined face. The sliding inclined face is particularly advantageous when the preformed part has the shape of a disc, a pellet or a ball. In any case, it is thus ensured that with the activation of the device, the preformed part can be reliably transferred into the gap space and also remains there, more specifically irrespective of mechanical vibrations and similar stresses.

In one configuration of the invention, at least one guiding element can be formed adjacent to the arm to ensure and support the movement of the preformed part into the gap space.

In a further development of the invention, the slide has a projection which merges into an indication area or comprises such an indication area.

Furthermore, the projection can simultaneously be used for a switch actuation.

When the preformed part is heated, for example due to lost heat of adjacent electronic components, the preformed part melts or changes its state of aggregation.

This causes the gap space to narrow, more specifically supported by the preloaded slide, as a result of which the position or state of the indication or switching device is changed.

With the melting of the preformed part and the change in position of the slide, a first switch can be closed and a second switch can be opened. This can of course be realized in a reversed manner in that a first switch is opened and a second switch is closed. The configuration of a switch as a change-over contact is also possible.

The teaching according to the invention allows an individual and deferred activation of the device, i.e. only in a case of use, as a result of which an unnecessary mechanical stress of the preformed part can be prevented irrespective of any storing times.

A surge arrester arrangement including at least one surge protection element which is subjected to heating in a case of overstress, comprising the aforementioned thermally triggerable indication or switching device having the features described above, is furthermore in accordance with the invention.

The invention will be described in more detail below with reference to an example embodiment and using figures, in which.

Figure 1:
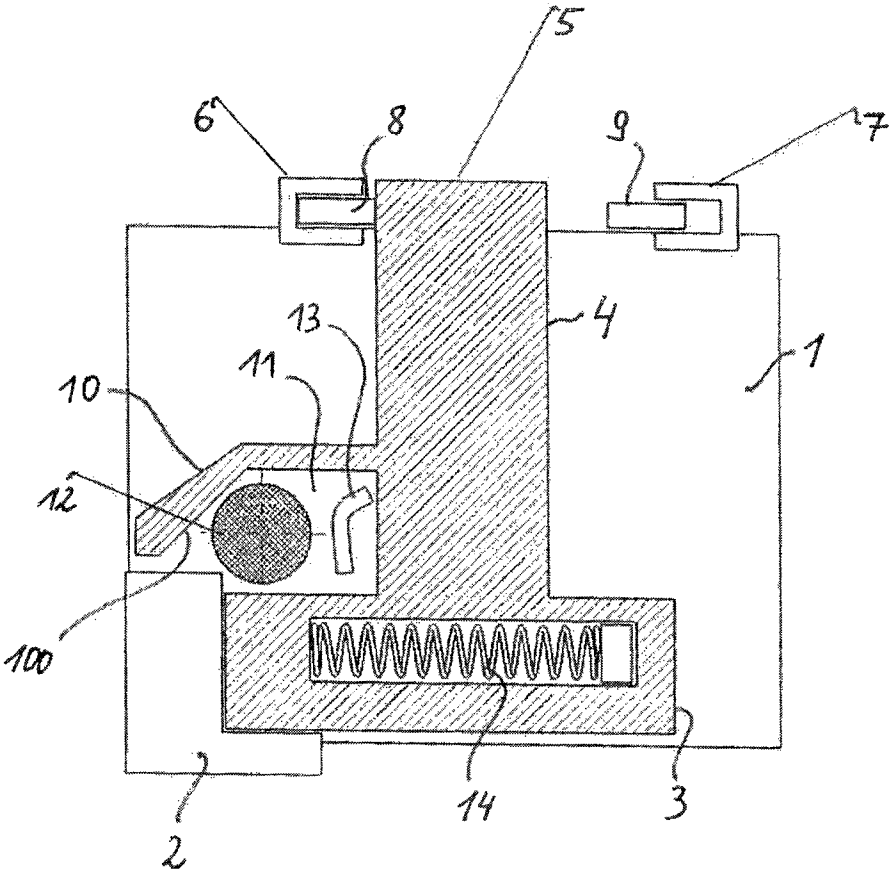
FIG. 1 shows a simplified representation of the device according to the invention in the initial state after mounting, with a loosely inserted preformed part and a not yet tensioned spring.
Figure 2:
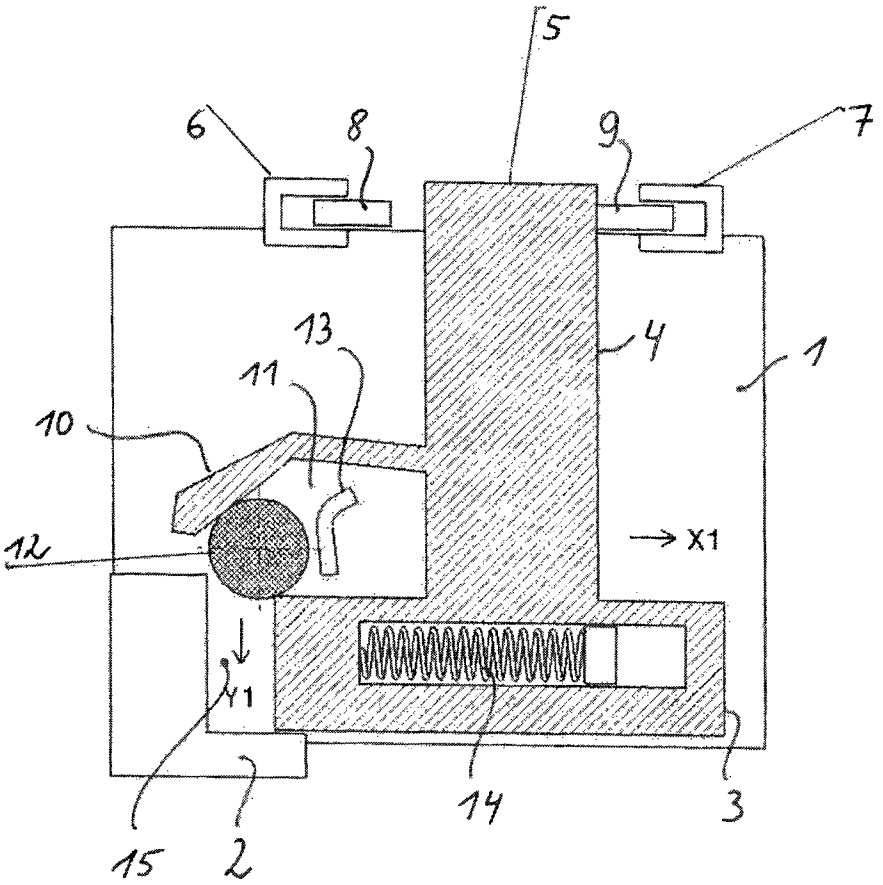
FIG. 2 shows a representation similar to that of FIG. 1, but with an outlined moving process for activating the device, the preformed part being moved in the direction of the gap space and the spring being simultaneously tensioned.
Figure 3:
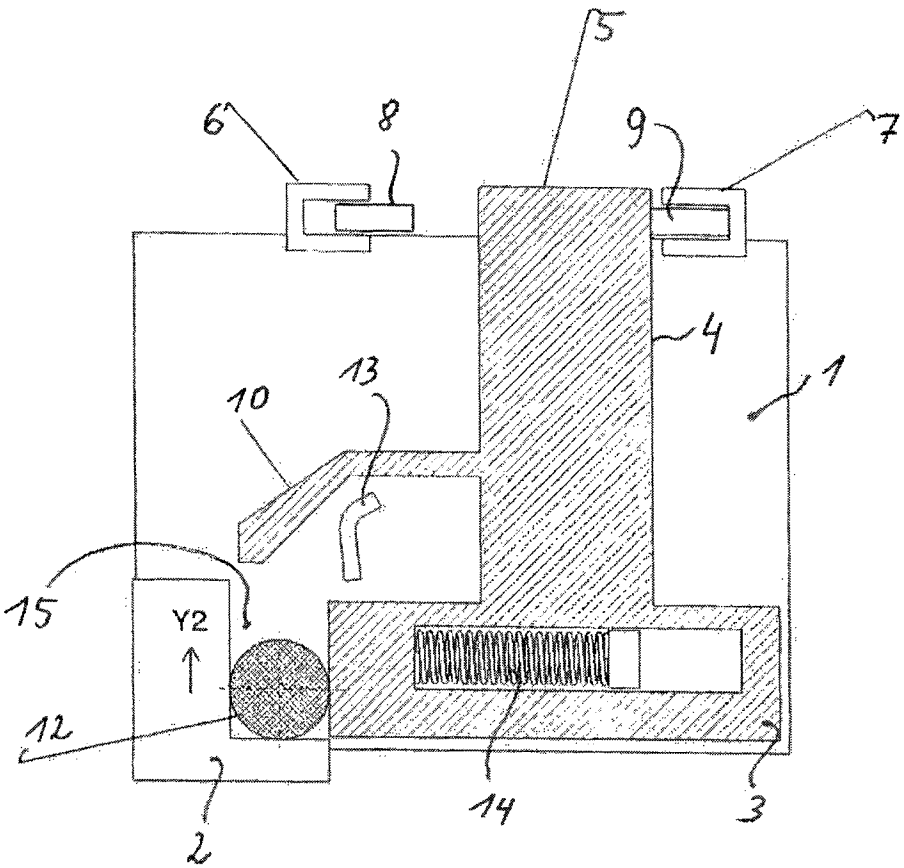
Figure 4:
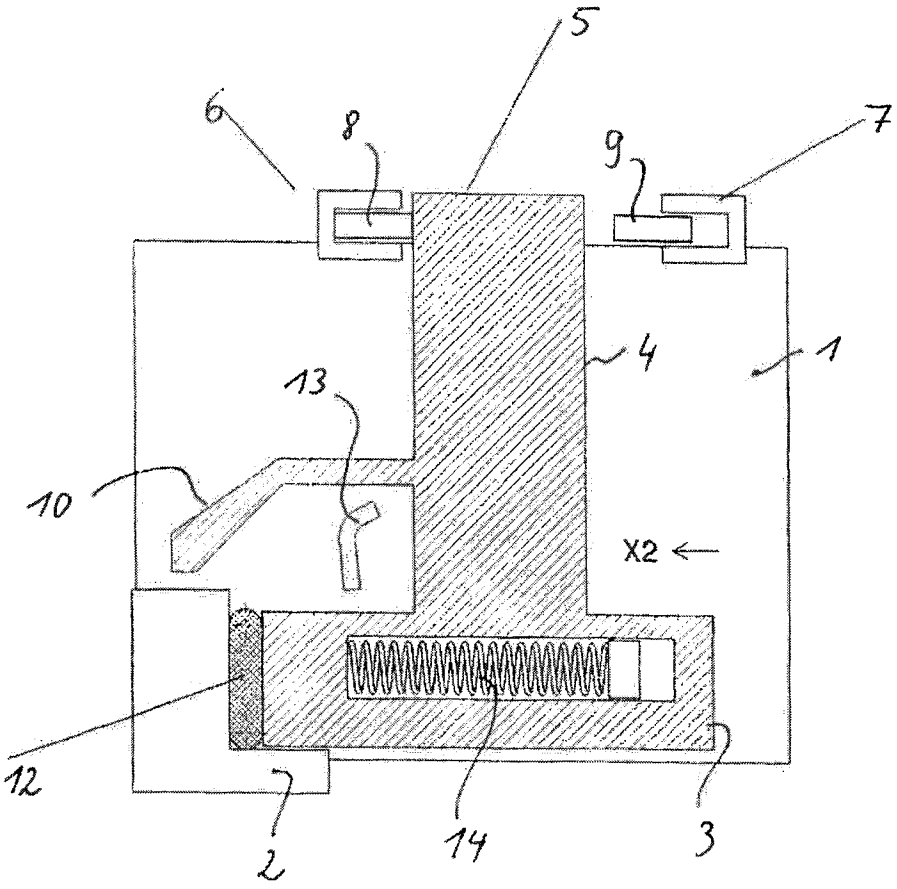

FIG. 3 shows a representation similar to that of FIGS. 1 and 2, the preformed part being however in its end position, i.e. located in the gap space, the spring being tensioned or the switch being activated; and FIG. 4 shows a representation similar to that of FIG. 3, but in the state in which the indication and switching device is triggered by the influence of heat which changes the state of aggregation of the preformed part, the slide having displaced the preformed part due to the spring preload under the final tension of the spring, with the result of a changed state of indication and a changed state of the symbolically represented switches.

The thermally triggerable indication or switching device according to the invention which is represented in more detail in the example embodiment below is based on a support 1 which includes a stop and guiding element 2 for a movable slide 3.

The slide 3 has a projection 4 which merges into an indication area 5.

One end of the projection 4 can furthermore actuate, i.e. open or close a first switch 6 and a second switch 7, which is symbolically illustrated by the action of actuating elements 8 and 9 for the switches 6 and 7.

An at least partially flexible or elastic, angled arm 10, which is connected to the slide 3 or the projection 4, delimits a receiving space 11 for a preformed part 12, for example a solder preformed part, along with a branch section of the slide 3. The preformed part 12 can be inserted from the top into the receiving space 11. A guiding element 13 is furthermore arranged within the receiving space 11. The slide 3 can be preloaded using a spring 14. In the example embodiment shown, the spring 14 is located within a cavity of the slide 3. Alternative possibilities for arranging the spring 14 with respect to the slide 3 are of course also possible here.

According to FIG. 2, to activate the device according to the invention, the slide 3 is moved in the direction X1, for example by means of a force application on the projection 4.

The solder preformed part 12 thus enters the gap space 15 generated by the movement of the slide under the effect of the now slightly resilient arm 10 and supported by the guiding element 13, as symbolized by the arrow representation in the direction Y1. This movement of the slide in the direction X1 also simultaneously causes a tensioning of the spring 14.

The change in the position of the slide also changes the position of the projection 4 and that of the indication area 5 including the elements 8 and 9 of the switches 6 and 7, which can also be understood from the illustration in FIG. 2.

According to FIG. 3, the preformed part 12 is now completely in the gap space 15. The slide 3 rests with its respective end face against the preformed part 12. A movement of the preformed part 12 in the direction Y2, i.e. out of the gap space 15, is prevented by the position of the arm 10.

After appropriate heat action on the preformed part 12, that is, upon reaching, for example, the melting temperature of a solder from which the preformed part is manufactured, the latter changes a state of aggregation. This is supported by the quasi-punch-like action of the slide 3 along with the force exerted by the spring 14.

The consequence of the movement of the slide in the direction X2 is again a change in the position of the indication area 5 as well as a change in the functional state of the first switch 6 or the second switch 7.

The supply of the necessary thermal energy for the deformation of the preformed part 12 can be effected via the element 2, wherein in this case, the element 2 is in particular made of a material which forms a heat sink.

The invention claimed is:

1. A thermally triggerable indication or switching device, having a movable, mechanically preloaded slide (3) which directly or indirectly triggers or actuates the indication or switching device (5; 6; 7), and having a preformed part (12) which changes its state of aggregation under the effect of heat, the preformed part (12), in the functional state, being adapted to be arranged so as to block the movable slide (3), characterized in that in the initial state, the preformed part (12) is loosely located in a receiving space (11), the slide (3) being moved in a position for transferring the preformed part (12) to the functional state such that a gap space (15) opens between the slide (3) and a slide stop (2), wherein, supported by an elastic or flexible arm (10) connected to the slide (3), the preformed part enters the gap space (15) and the slide (3) is preloaded, and the elastic or flexible arm (10) thus secures the preformed part (12) in the gap space (15).

2. The thermally triggerable indication or switching device according to claim 1, characterized in that the arm (10) has a sliding inclined face (100) for supporting the movement of the preformed part (12) to activate the indication or switching device (5; 6; 7).

3. The thermally triggerable indication or switching device according to claim 1, characterized in that at least one guiding element (13) is formed adjacent to the arm (10) to ensure the movement of the preformed part (12) into the gap space (15).

4. The thermally triggerable indication or switching device according to claim 1, characterized in that the slide (3) includes a projection (4) which has an indication area and/or a switch actuating member.

5. The thermally triggerable indication or switching device according to claim 1, characterized in that the preformed part (12) melts when the preformed part (12) is heated, for example due to lost heat of adjacent electronic components, as a result of which the gap space (15) narrows supported by the preloaded slide (3), which leads to a change in the position or state of the indication or switching device (5; 6; 7).

6. The thermally triggerable indication or switching device according to claim 5, characterized in that with the melting of the preformed part (12) and the change in position of the slide (3), a first switch (6) closes and a second switch (7) opens, or vice versa.

7. The thermally triggerable indication or switching device according to claim 1, characterized in that the activation of the device is carried out individually and in a deferred manner, i.e. only in the case of use.

8. A surge arrester arrangement comprising at least one surge protection element which is subject to heating in case of overstress, comprising a thermally triggerable indication or switching device according to claim 1.

* * * * *